US006256397B1

(12) United States Patent
Komatsu

(10) Patent No.: US 6,256,397 B1
(45) Date of Patent: Jul. 3, 2001

(54) BODY-SENSIBLE SWINGING AND VIBRATING APPARATUS

(75) Inventor: Akira Komatsu, Koto-ku (JP)

(73) Assignee: Bodysonic Laboratory, Inc., Tokyo (JP)

( * ) Notice: Subject to any disclaimer, the term of this patent is extended or adjusted under 35 U.S.C. 154(b) by 0 days.

(21) Appl. No.: 09/138,765

(22) Filed: Aug. 24, 1998

(30) Foreign Application Priority Data

Aug. 25, 1997 (JP) ..... 9-227911

(51) Int. Cl.[7] ..... H04R 25/00

(52) U.S. Cl. ..... 381/396; 381/86; 381/333; 381/389; 381/395; 601/47

(58) Field of Search ..... 381/396, 151, 381/340, 86; 601/47

(56) References Cited

U.S. PATENT DOCUMENTS 3,455,296 * 7/1969 Mccales ..... 128/33
3,556,088 * 1/1971 Leonardini ..... 601/47
4,064,376 * 12/1977 Yamada ..... 601/47
4,641,345 * 2/1987 Takahashi ..... 381/86
5,894,263 * 4/1999 Shimakawa ..... 340/368.1

* cited by examiner

*Primary Examiner*—Curtis Kuntz
*Assistant Examiner*—Dionne N. Harvey
(74) *Attorney, Agent, or Firm*—Oliff & Berridge, PLC

(57) ABSTRACT

A body-sensible swinging and vibrating apparatus is provided for enhancing the feeling of presence while a user is listening to the music or is using the playing unit.

In the body-sensible swinging and vibrating apparatus, an arm is hung at the central lower portion of a swinging and vibrating stand (a seat) as well as an iron core is attached to said arm, the upper position of the arm is rotatively supported above the iron core to enable the swinging and vibrating stand to be inclined in every direction, a plurality of electromagnets are placed peripherally in the horizontal direction of the iron core. When sound or picture is outputted for audio, movies, video games or the like, the electromagnets are driven by the swinging signal and vibrating signal that are harmonized with the picture or the sound, and the swinging and vibrating stand is activated by said swinging signal and said vibrating signal.

5 Claims, 5 Drawing Sheets

BODY-SENSIBLE SWINGING AND VIBRATING APPARATUS

BACKGROUND OF THE INVENTION

1. Field of the Invention

The present invention relates to a body-sensible swinging and vibrating apparatus for offering the feeling of presence.

2. Description of the Related Art

Insofar, the present inventor has proposed a lot of body-sensible acoustic apparatuses in which, during an audio reproduction, employing a low sound region of about 20 to 150 Hz in the audio signal as a supply source, a vibrator is driven by the low sound region signal to make a generated vibration felt to give more increased feeling of presence, thereby to bring an effect medically and in psychotherapy.

Further, a flight simulator which stimulates a flight of airplane to swing a simulated cockpit in accordance with a flight condition by a large scale hydraulic pressure apparatus has been employed for offering the feeling of presence. Another apparatus gives a user such a feeling as driving a motorbike or a roller coaster by swinging a saddle back and forth, right and left, and upward and downward. In this apparatus, an actuation of a motor attached to the saddle is controlled by CPU to enhance the user's feeling of presence.

The present invention relates to provide a body-sensible swinging and vibrating apparatus for enhancing the feeling of presence in simulation, while listening to the music or playing a game.

Conventionally, in an electric-mechanical vibration transducer that has been employed for acoustically body-sensible apparatus, a large mass permanent magnet is hung within a mounting container and a coil is fixed in the container (hereinafter referred to as transducer).

When a user listens to the music on a chair, which is vibrated in a low sound region by the transducer attached thereto, a feeling of presence in an imaginary world induced by the music played in a hall is obtained.

Further, in some game unit, a user's body is inclined or swung corresponding to a situation. For that purpose, as described previously, there is an apparatus that swings a cockpit by means of a hydraulic apparatus, a motor, an air cylinder or the like is employed for a swinging apparatus. The air cylinder, however, requires a complicated piping system for an air injection/exhaustion apparatus, and the motor is more frequently used for swinging and vibrating apparatuses due to its structural simplicity.

A swinging apparatus is effectively achieved to tremble a human body supporting platform by rotating a regularly/reversely, or by repeating the injecting and exhausting the air into and from an air cylinder, in which one reciprocating operation makes one cycle (1 Hz), capable of realizing relatively large swinging motion at a low frequency. When using the motor, a regular/reverse rotation must be repeated in accordance with the frequency, and it is greatly difficult to realize a rotation by a desirable rotation angle (amplitude) in the range of tens of Hz to hundreds of Hz. It is the same situation as in case of an air cylinder used for an apparatus.

Therefore, since in the apparatus using a motor or an air cylinder a response speed to an input of a swinging signal or a vibrating signal is low, it is difficult to obtain a swinging motion with feeling of speed and impact. The above problem is solved, as an example, by excessively inclining and swinging a seat of the game machine, and correspondingly inclining and swinging the body of a player who steers on the seat during a motorbike race simulation (a video game).

For example, when the simulated motorbike slowly runs on a wavy road, the player's body swings slowly, and when it slowly runs on a gravel road, the player feels a rugged impact.

However, when the simulated bike runs fast on the gravel road, successive large impacts generated on the road cannot be reproduced. This is because the frequency of the input signal is too high for the motor to follow the high frequency by rotating regularly/reversely. Therefore, the inclination and the swinging motions do not agree with the driving condition, thereby deteriorating a pleasure of the game and making the player lose his interest. Some players of the game machine do not sit but stand while steering the simulated motorbike.

In summarizing the example of a simulated motorbike or roller coaster, the actual swinging motion thereof includes a slowly but largely right and left swinging motion and a vibrating motion with various impacts. Therefore, it is possible to produce satisfying game machines incorporating the conventional swinging apparatus with use of a motor, an air cylinder or the like. That is, though the above vibrating apparatus is suitable to provide a body-sensible impact, it is constructively impossible for the apparatus to offer a large right and left swinging motion.

SUMMARY OF THE INVENTION

Therefore, an object of the present invention is to provide a body-sensible swinging and vibrating apparatus which gives a user a swinging motion and impact to enhance the feeling of presence.

To achieve the above object of the invention, according to one aspect of the present invention, there is provided a body-sensible swinging and vibrating apparatus, wherein an arm is hung at the central lower portion of a swinging and vibrating stand as well as an iron core is attached to the arm, the upper position of the arm being rotatably supported above the iron core, the swinging and vibrating stand being capable of inclining in every direction, a plurality of electromagnets being placed peripherally in the horizontal direction of the iron core, and the electromagnets being driven by the swinging signal and the vibrating signal.

According to another aspect of the present invention, in a body-sensible swinging and vibrating apparatus, the electromagnets are placed at four positions horizontally about the iron core.

According to a still further aspect of the present invention, in a body-sensible swinging and vibrating apparatus, the swinging and vibrating stand is capable of inclining in every direction as serving the central lower portion of the swinging and vibrating stand as a bearing as well as the electromagnets are placed at four positions horizontally about the iron core, with the electromagnets being placed at the lower portion of the iron core and the electromagnets being driven by the swinging signal and the vibrating signal.

According to a still further aspect of the present invention, in a body-sensible swinging and vibrating apparatus, the swinging signal is an wave form of a fluctuation element with longer wavelength than the vibrating signal, and the vibrating signal is an audio signal in a low sound region.

According to a still further aspect of the present invention, in a body-sensible swinging and vibrating apparatus, when sound or picture is outputted for audio, movies, video games or the like, the swinging and vibrating stand is activated by the swinging signal and the vibrating signal harmonized with the picture or the sound.

The swinging and vibrating stand may be used as a driver's seat, seat, couch, bed or the like, which depends on the setting condition of the apparatus for a user how to use the apparatus.

BRIEF DESCRIPTION OF THE DRAWINGS

With reference to the accompanying drawings.

DESCRIPTION OF THE PREFERRED EMBODIMENTS

In the following example, a preferred embodiment is described to illustrate the invention based on the accompanying drawings.

Figure 1:
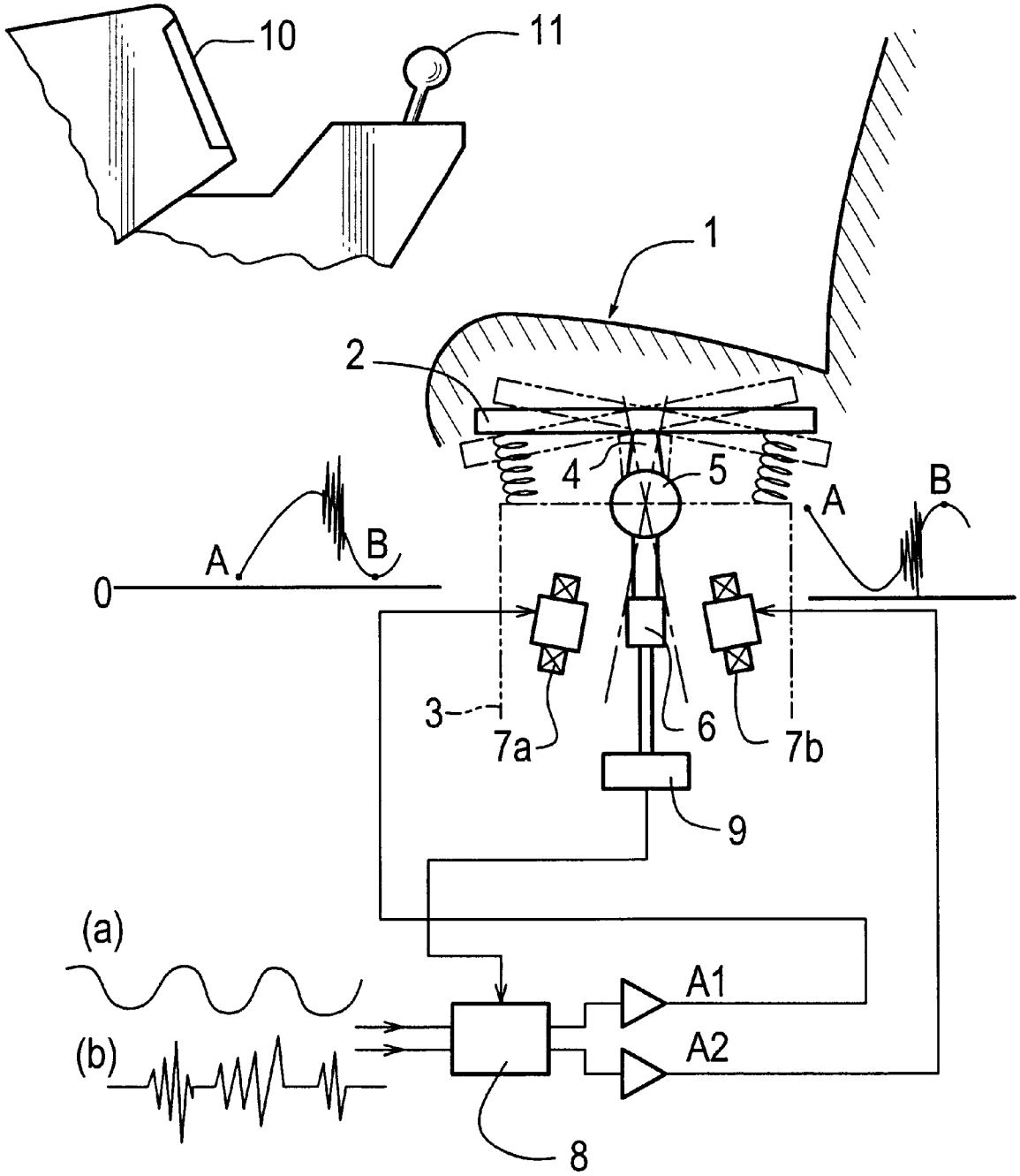
FIG. 1 is a block diagram showing a body-sensible swinging and vibrating apparatus according to the present invention.

Now referring to FIG. 1, a seat 1 where a player of simulations, games or the like sits is fixed to a swinging and vibrating stand 2 of a body-sensible swinging and vibrating apparatus. The swinging and vibrating stand 2 is supported by an arm 4 protruding from a frame 3. When the arm 4 is positioned vertically, the swinging and vibrating stand 2 is held horizontally.

An intermediate portion of the arm 4 is supported by a ball bearing 5, so that the top end and the bottom end of the arm 4 can freely swing like a goose-neck. An iron core 6 to be attracted (hereinafter refer to as "iron core") is attached to the lower position of the arm 4.

Incidentally, at four corners of the swinging and vibrating stand 2, in order to keep the swinging and vibrating stand 2 in a horizontal posture when it is non-actuated and to prevent the iron core 6 from colliding with electromagnet 7, a coil-spring 2' is provided.

Figure 2:
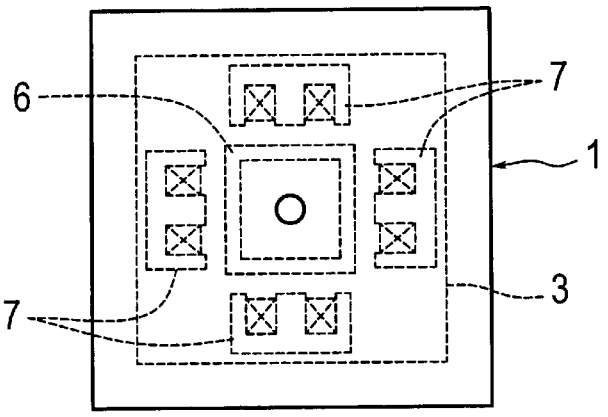
FIG. 2 is a plan view showing the body-sensible swinging and vibrating apparatus of FIG. 1.
Figure 3:
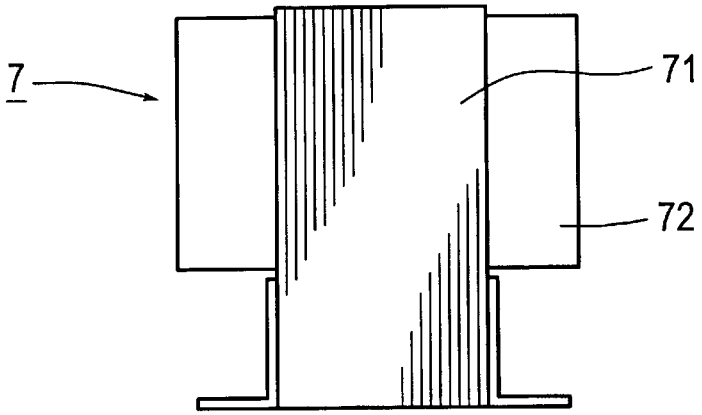
FIG. 3 is a side view showing a electromagnet used in the body-sensible swinging and vibrating apparatus of FIG. 1.
Figure 4:
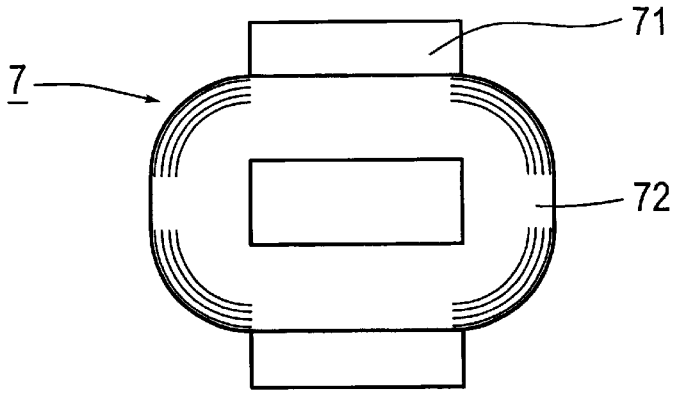
FIG. 4 is a front view showing the electromagnet of FIG. 3.

In order to control the swinging motion of the arm 4, electromagnets 7*a* and 7*b* are disposed in such a manner as facing to the iron core 6 respectively to make the magnetic attraction on and off. Thus, in order to make the arm 4 swing freely, the electromagnets must be arranged at at least three positions. According to an embodiment of the present invention, as illustrated in FIG. 2, there are electromagnets 7 placed in four positions in the frame body 3. Each electromagnet is arranged so as to attract the iron core 6 by its electromagnetism. As shown in FIGS. 3 and 4, the electromagnet 7 is arranged in such a manner that a coil 72 is wound on an E-shaped iron core 71. It is noted that a shape of the iron core is not restricted hereto, but a U-shaped iron axis may be used.

Next, a force-relation between the iron core 6 and the electromagnets 7*a*,7*b* is explained.

As shown in FIG. 1, assuming a pair of electromagnets 7*a*,7*b* disposed bi-symmetrically relative to the iron core 6 being situated vertically, an output wave form as shown in FIG. 1 is inputted from output amplifiers A1 and A2 in accordance with an information sent out from a device by which a simulated movement is reproduced or transmitted from an operator. At previous step of the output amplifiers A1 and A2, a swinging signal a and a vibrating signal b are inputted to a mixing amplifier 8 to be mixed and amplified. In accordance with the signal from the output amplifiers A1 and A2, in case the force attracting the iron core 6 to the electromagnet 7*a* is applied strongly, a force attracting the iron core 6 to the electromagnet 7*b* is applied weakly relatively to the intensity of attracting force of the electromagnet 7*a* so as to balance each other. To the contrary, in case the force attracting the iron core 6 to the electromagnet 7*b* is applied strongly, the force attracting the iron core 6 to the electromagnet 7*a* is applied weakly similarly to the former case. A swinging and vibrating motion of the iron core 6 may be realized as explained above. For reference, on the other hand, a vibration may be applied wherever the iron core 6 is positioned, even during swinging.

Further, a position detector 9 placed at the bottom end of the arm 4 detects a position (orbit) of the arm 4 that swings like a pendulum or vibrates, and the detected signal is fed back to the mixing amplifier 8. The detected signal is used for correcting the bias (a neutral position correction for the arm) and corrects a variation of the angle which is caused by the weight of the human body at the seat 1. That is, the output of the right and left electromagnets 7*a* and 7*b* is adjusted.

Here, the swinging signal a is an wave form including longer wavelength element than that of the vibration signal b, by which the seat 1 is largely swung right and left or is held in an inclined state for a short period of time. The vibrating signal b makes the seat vibrate at a particular state and at the range of about 20–150 Hz (alternatively, an audio signal at a low sound region or a body sonic signal that is proposed by the present inventor may be available).

That is, the detector 9 has a feed-back function to prevent the iron core 6 from colliding with the electromagnet 7 in such a manner as information from the detector 9 is fed back to a signal output source. Further, as an auxiliary measure for supporting the feed-back function, the spring 2' is provided. The spring 2' supplementarily supports a load applied to the swinging and vibrating stand 2, that is, a weight of an operator and an inertia force in swinging and vibrating. Further, the spring 2' may play a function as a damper to prevent the iron core 6 from colliding with the electromagnet 7.

Further, in order to generate a swinging and vibrating motion back and forth, too, two pairs of the mixing amplifiers 8 and their peripheral appliances are prepared. The swinging and vibrating motions in the tilted direction are divided into elements in two directions perpendicular to each other horizontally to be swung and vibrated, respectively.

The above-explained body-sensible swinging and vibrating apparatus is incorporated in association with audio devices, video game machines or the like and is used for enhancing the player's feeling of presence. For example, in a car racing action game, when a car on the screen suddenly accelerates or decelerates, the signal is inputted from output amplifiers A1 and A2 to the electromagnets 7*a* and 7*b* so that the seat 1 can be inclined back and forth. In a situation where a car is contacted with others at the side, the signal is inputted so that the seat 1 can be inclined right and left. These can be realized by varying the swinging signal a.

Further, when a car runs into a mountain road from a highway (pavement), a player receives the impact produced by the different ground surfaces, which can be controlled by the vibrating signal b. The seat 1 must be inclined in order to simulate acute curves in mountain roads on screen which can be realized by combining the variation of the swinging signal a with that of the vibrating signal b.

Further, as illustrated in FIG. 1, when the above situation is established in a car racing game, the player can feel as if he drove a car by operating a handle lever 11 while watching the road where his operating car runs (the running condition) in a display screen 10 of the game machine.

As described above, it is needless to say that the player's feeling of presence can be more enhanced by using the body-sensible swinging and vibrating apparatus during the audio reproduction.

Figure 5:
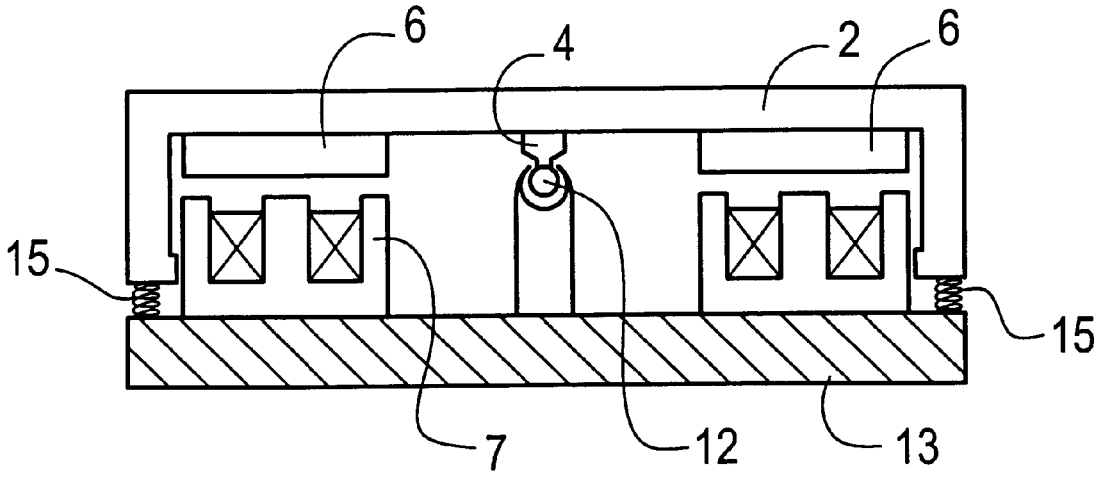
FIG. 5 is a side view showing a modification of the drive unit for the body-sensible swinging and vibrating apparatus according to the present invention.

Next, referring to FIG. 5, a modification of the body-sensible swinging and vibrating apparatus will be described.

The swinging and vibrating stand 2 in the seat 1 can be inclined in horizontally by a movable joint 12. The iron core 6 are mounted on both ends of the back surface of the swinging and vibrating stand 2. The movable joint 12 is fixed to a base 13, and electromagnets 7 are attached to the base 13 so as to face the iron core 6 (a position to the base shown). In such an arrangement, the arm 4 is not required to be elongated, thereby the frame can be flattened.

Figure 6:
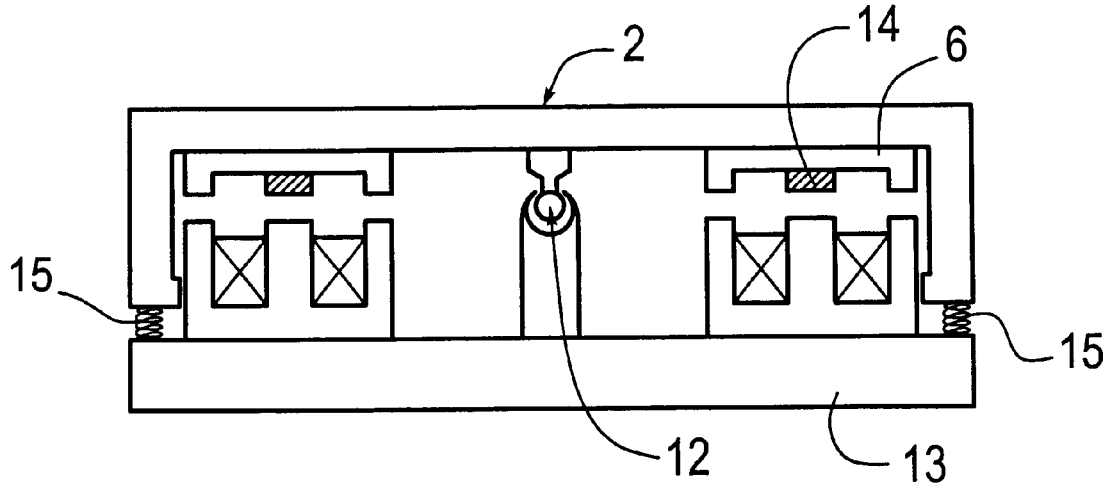
FIG. 6 is a side view showing a modification of the drive unit of FIG. 5.
Figure 6A:
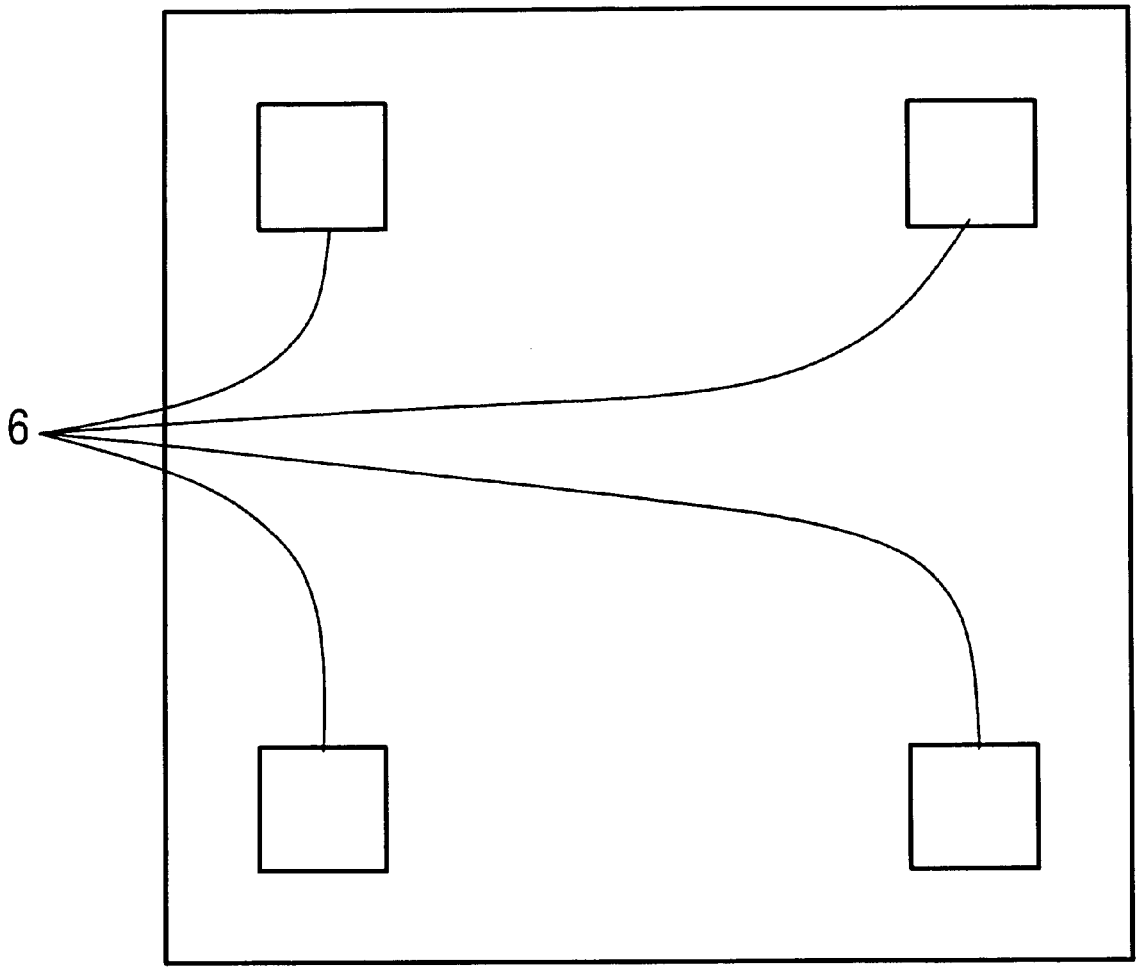
FIG. 6A is a back view of the swinging and vibrating stand showing four iron cores attached to the back of the swinging and vibrating stand at the four corners.

Further, as shown in FIG. 6, on the iron cores 6 mounted on the back of the swinging and vibrating stand 2, permanent magnets 14 are mounted. As shown in FIG. 6A, four iron cores are attached to the back of the swinging and vibrating stand at the four corners. And, depending on the combination of the polarity between the electromagnet 7 and the permanent magnet 14, the swinging and vibrating stand 2 may be balanced horizontally or inclined rapidly. Further, by a selected polarity of the electromagnet 7 at the time of operating, the electromagnet force may be multiplied by the permanent magnet (both in replusion and attraction), or balanced at an appropriate posture. Even in any cases, four springs 15 will act as a damper which will function for avoiding from a mechanical abutting of the electromagnets 7 to the permanent magnet 14 (the situation is the same as that in the embodiment shown in FIG. 1).

Figure 7:
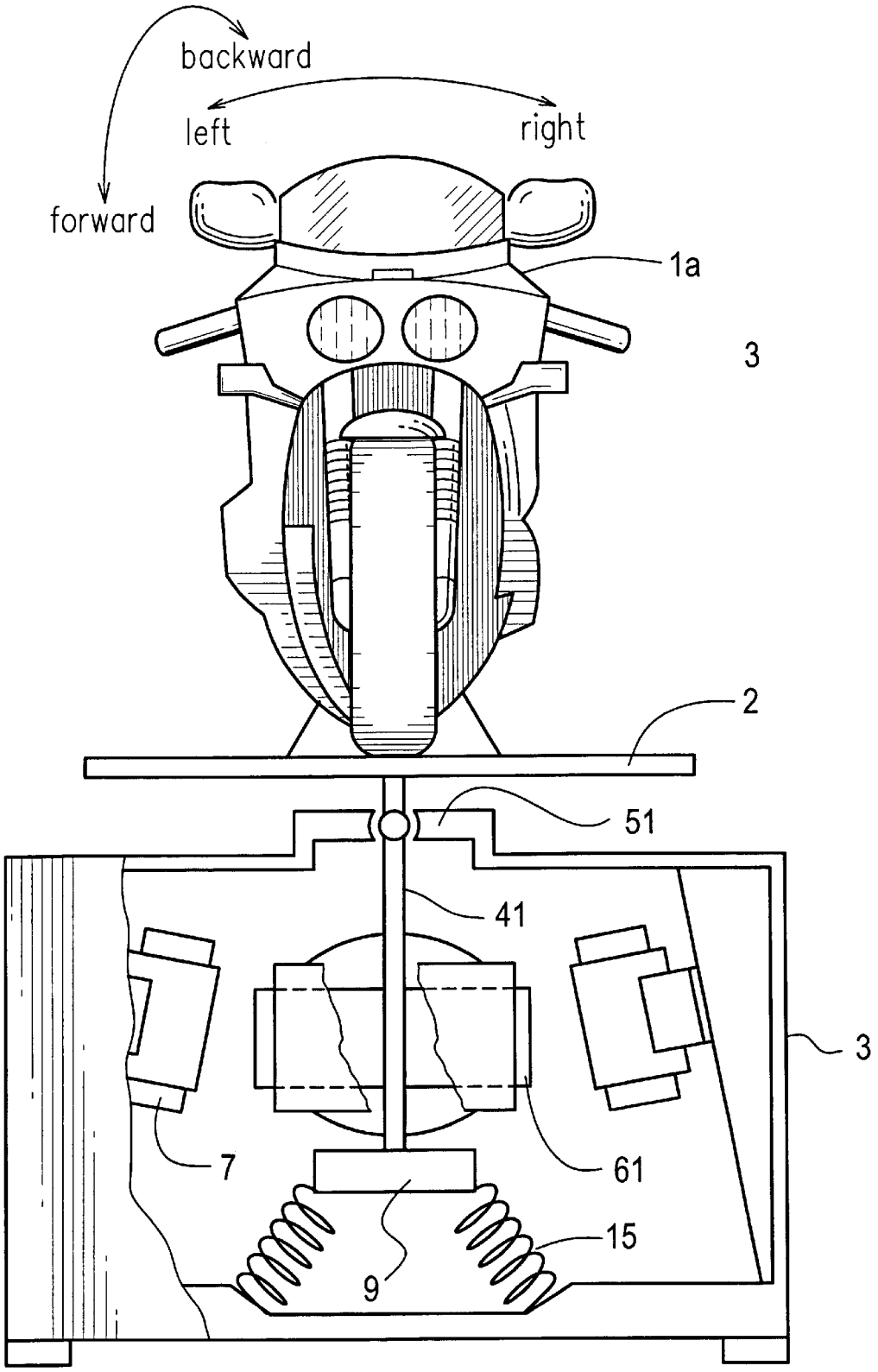
FIG. 7 is a front view showing the body-sensible swinging and vibrating apparatus to which a simulated motorbike is provided according to an embodiment of the present invention.

According to the another embodiment, as illustrated in FIG. 7, a frame 3 of the body-sensible swinging and vibrating apparatus is of rectangular in section. Each electromagnet 7 is configured as a block with each side of approximate 20 cm and two pairs of electromagnets 7 are attached to the frame 3 symmetrically with respect to the iron core 61. The body-sensible swinging and vibrating apparatus comprises a movable shaft 41 supported by a ball bearing 51 at the upper central portion of the frame and the swinging and vibrating stand 2 fixed to the upper end of the movable shaft 41. The iron core 61 is attached to the movable shaft 41. The iron core 61 is also adapted to swing about the ball bearing 51 like a pendulum. A simulated motorbike is mounted on the swinging and vibrating stand 2, in which the force by the weight is set up to approximate 125 $kg \cdot m/s^2$, 0–13° of the bank angle is prepared to be tilted from the vertical movable shaft, and the action force of the iron core 61 ranging approximate 0–28 $kg \cdot m/s^2$ is outputted.

The simulated motorbike is formed of plastic exclusive of the main body, so the load is reduced to realize light weight.

A position detector 9 is placed at the bottom end of the shaft 41 and springs 15 are provided between the frame 3 and the detector 9, which are tensioned at all times to keep the movable shaft 41 vertically.

Therefore, when the electromagnets 7 are activated by the swinging signal a and the vibrating signal b, the swinging and vibrating stand 2 swings and vibrates, concurrently with which, the simulated motorbike also swings and vibrates. Consequently, a player on the simulated motorbike can have the feeling of the swinging and vibrating motion, and with the help of the display screen of the game machine, too, the player can obtain the feeling of presence.

According to the example of the present invention, although the simulated motorbike is mounted on the swinging and vibrating stand 2, other vehicles than motorbike are also available. Further, the seat 1*a* shown in FIG. 1 may be fixed to the swinging and vibrating stand 2 and modified like a cockpit to enhance the feeling of presence.

It has thus been described the structure of the apparatus, and according to the invention of claim 1, since the response of the swinging and vibrating signals of the electromagnet is reliable, the swinging and vibrating stand can be swung and vibrated at a desired level.

According to the inventions of claims 2 and 3, the electromagnet is arranged in two horizontal directions perpendicular to each other or vertical direction, so that multiple directions of the swinging and vibrating motion is divided into the elements of horizontal or vertical direction, thereby facilitating the control.

According to the invention of claim 4, the iron core is attached in the horizontal direction directly to the lower portion of the swinging and vibrating stand, and the length of the arm can be reduced. Therefore, the entire apparatus can be made flat, resulting in an advantage for the apparatus design.

According to the invention of claims 5 and 6, when the swinging and vibrating stand is used in audio, movie, video game or the like, signal in the low sound region among these video signals or sound signals is sampled to be modified to a swinging and vibrating signals for the actuation of the electromagnet. Therefore, the swinging and vibrating motions are audio-visually harmonized to enhance the feeling of the realistic motion which does not actually happen.

It is, therefore, evident that there has been provided in accordance with the present invention, an apparatus which fully satisfies the aims and advantages heretofore mentioned. While this invention has been described in conjunction with preferred embodiment thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. A body-sensible swinging and vibrating apparatus comprises:

an arm extending through a ball joint, the ball joint mounted on a frame, wherein an upper end of the arm is attached to a swinging and vibrating stand in unitary manner and a lower end of the arm below the ball joint is attached to an iron core, a plurality of electromagnets located on the frame surrounding the iron core in a plane, a plurality of springs fixed between the swinging and vibrating stand and the frame to locate the swinging and vibrating stand in a neutral position, a position detector that detects a position of the arm relative to the frame, and an amplifier that outputs an output signal comprising at least one of a swinging signal and a vibrating signal, to the electromagnets to energize each electromagnet selectively to move the iron core in accordance with information inputted, wherein the amplifier is controlled to output the output signal by feedback from signals from the position detector.

2. A body-sensible swinging and vibrating apparatus according to claim 1, wherein two pair of electromagnets are disposed perpendicularly and symmetrically in the plane relative to the iron core.

3. A body-sensible swinging and vibrating apparatus comprises:

a swinging and vibrating stand supported pivotally on a lower surface of the stand and at a central portion of the lower surface through a ball bearing provided on a frame, four iron cores attached to the lower surface of the swinging and vibrating stand at four locations, four electromagnets mounted on the frame such that the four electromagnets face the four iron cores, a plurality of springs interposed between the swinging and vibrating stand and frame to maintain the swinging and vibrating stand in a neutral position when the electromagnets are not energized and to function as a damper, an amplifier that outputs at least one of a swinging signal and a vibrating signal to the electromagnets in accordance with input information, and a bank angle detector provided on the frame to detect an angle of bank of the swinging and vibrating stand, wherein information of the bank angle is fed back to the amplifier to maintain a banked position of the swinging and vibrating stand.

4. A body-sensible swinging and vibrating apparatus according to claim 1, wherein the swinging signal has a frequency lower than a frequency of the vibratory signal and a frequency of the vibrating signal is in a low audio frequency region.

5. A body-sensible swinging and vibrating apparatus according to claim 1, wherein a swinging and vibrating signal is inputted at the time of outputting of the sound or image of such as any audio, film or video-game.

* * * * *